United States Patent [19]

Kennedy

[11] Patent Number: 4,741,663

[45] Date of Patent: May 3, 1988

[54] LOCKING AND SLIDING SYSTEM

[75] Inventor: Michael E. Kennedy, Dubuque, Iowa

[73] Assignee: Deere & Company, Moline, Ill.

[21] Appl. No.: 925,647

[22] Filed: Oct. 29, 1986

[51] Int. Cl.[4] ..... E02F 3/633

[52] U.S. Cl. ..... 414/695.5; 188/41; 414/695; 414/742

[58] Field of Search ..... 414/695, 705, 728, 742, 414/695.5; 280/456 R; 188/41, 42

[56] References Cited

U.S. PATENT DOCUMENTS

| | | | |
|---|---|---|---|
| 3,436,099 | 4/1969 | Long | 280/456 R |
| 3,608,930 | 9/1971 | Saran et al. . | |
| 3,614,134 | 10/1971 | Saran et al. . | |
| 3,627,155 | 12/1971 | Van Der Zyl | 280/456 R X |
| 3,680,724 | 8/1972 | Schaeff . | |
| 3,741,415 | 6/1973 | Lee et al. . | |
| 3,788,674 | 1/1974 | Casey . | |
| 3,891,065 | 6/1975 | Iijima et al. | 188/41 |
| 3,929,239 | 12/1975 | Shumaker . | |
| 3,980,000 | 9/1976 | Iijima et al. | 414/695 X |
| 4,046,346 | 9/1977 | Iijima et al. | 414/705 X |
| 4,106,644 | 8/1978 | Williams . | |
| 4,113,031 | 9/1978 | Venable | 414/695 X |

*Primary Examiner*—Robert J. Spar
*Assistant Examiner*—P. McCoy Smith

[57] ABSTRACT

A side shift backhoe mounted on a sliding frame adapted for sliding transversely along upper and lower tracks of a main frame and in which the sliding frame and one of the tracks have matching chamfered surfaces and the sliding frame and other track have matching horizontal surfaces, and a power device extending between the sliding frame and main frame to effect movement of the sliding frame vertically in one direction to tightly engage the chamfered surfaces and in the opposite direction to cause the horizontal surfaces to engage so that the weight of the backhoe is carried on said other track having the matching horizontal surface.

9 Claims, 3 Drawing Sheets

LOCKING AND SLIDING SYSTEM

BACKGROUND OF THE INVENTION

A side shift backhoe in general is composed of a main transverse frame that has some type of retractable legs for ground support and when retracted the frame is carried on one end of a tractor. The transverse frame normally has upper and lower horizontal tracks extending substantially the full width of the frame. A backhoe supporting slide frame is carried on the tracks. One of the difficulties in providing such a slide frame and transverse frame lies in the ability to lock the slide frame in any given position while with the same structure having the ability to relatively freely slide the slide frame along the tracks.

One method used for providing the sliding and locking action is through the use of a chamfered surface on the upper track and normally on the upper edge or surface thereof and a chamfered surface on the lower track and normally on the lower surface thereof. The slide frames have hook portions that extend over the upper track and under the lower track. The hook portions have matching chamfered surfaces for engaging the chamfered surfaces on the respective tracks. Small hydraulic cylinders are provided on the slide frame and are used to force a separation between the slide frame and tracks so as to tighten or create a wedge like action between the chamfered surfaces.

One of the problems with the afore-mentioned structure is that when the hydraulic cylinders are released, the slide frame still has two chamfered surfaces engaging two chamfered surfaces on the transverse frame. Although, there is not the strong wedging action that is created when the hydraulic cylinders are extended; nevertheless, when it is a desire to slide the slide frame into a new position, it is often very difficult since the chamfered surfaces tend to create binding between the surfaces. Also, the upper chamfered surfaces carry almost the entire weight of the backhoe and the slide frame which creates a strong wedging action between these surfaces.

With the above in mind, it is the primary object of the present invention to provide a transverse frame and a slide frame in which the wedging action occurs only along the upper track on the transverse frame and generally in the area of the top surface of the track. At the upper track, the slide frame is provided with a part that extends over the edge of the track and has a downwardly inclined surface that engages a matching chamfered surface on the track. Hydraulic cylinders are placed so that upon extension they force separation of the two frames. This causes interaction between the inclined surface on the slide frame and the matching chamfered surface on the transverse frame so as to raise slightly the slide frame. When the cylinders are relaxed, the chamfered and inclined surfaces have the opposite effect and the slide frame is permitted to drop. With respect to the lower track, the slide frame has a plate like member with a horizontal surface that fits over the upper horizontal edge of the hozizontal track and engages that edge only when the slide track is lowered through retracting the cylinders. Thus, when it comes necessary to slide the slide frame relative to the two tracks on the transverse frame, there is a set of horizontal engaging surfaces and it is relatively easy to move the slide frame. Even though the upper incline surface is in engagement with the chamfered surface, the main weight of the sliding frame and backhoe are on the horizontal engaging surfaces at the lower track. Therefore, there would be very little if any binding between the slide frame and the transverse tracks as the slide frame is shifted along the tracks. Binding, particularly between chamfered surfaces often occur due to tilting of the slide frame and is minimized by the engagement of the two horizontal surfaces along the lower track.

DESCRIPTION OF THE PREFERRED EMBODIMENT

Figure 1:
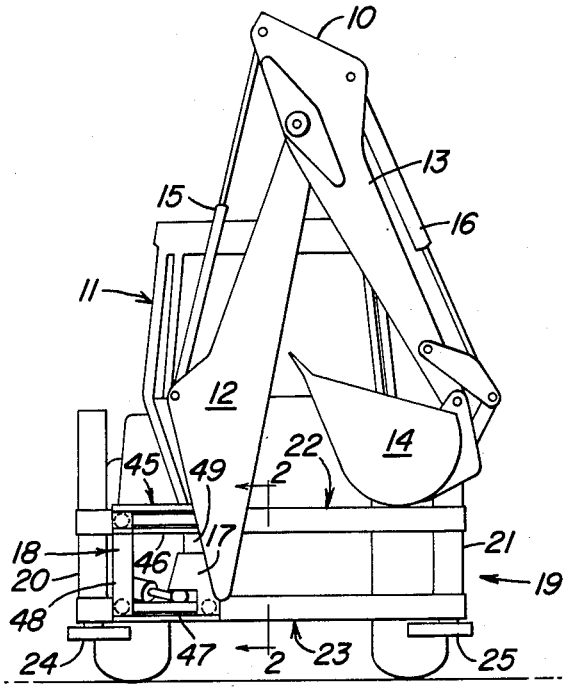
FIG. 1 is a view taken from the rear of a tractor and side shift backhoe combination.

Referring to the drawings, a side shift backhoe, indicated it its entirety by reference numeral 10 is supported on the rear portion of a tractor 11. The backhoe 10 is composed of a main boom 12, dipper stick 13 and a bucket 14. Suitable hydraulic cylinders such as at 15, 16 are utilized to move the dipper stick relative to the boom and the bucket 14 relative to dipper stick. A hydraulic cylinder, not shown, extends between the boom 12 and a swivel subframe, indicated by the reference numeral 17, which in turn is mounted in conventional manner on a vertical pivot carried on a slide frame, indicated in its entirety by the reference numeral 18. A main transversely extending frame 19 is supported on the tractor and is composed of end columns 20, 21 that are rigidly interconnected by upper transverse track structure 22 and lower transverse track structure 23. The columns 20, 21 are hollow and have vertically extending hydraulic cylinders, not shown, retained therein for operating respective stabilizing feet 24, 25.

As is clearly apparent from viewing FIG. 1, the slide frame 18 is adapted to move transversely along the upper and lower track structures 22, 23. The track structures extend substantially the full width of the tractor and the side frame 18 and its subframe 17 may be moved to any position along the track structures. This is desirable when a backhoe is required to move material close to a foundation or within a very limited vertical space. The present invention is generally directed to the means for mounting and permitting sliding of the slide frame 18 along the respective track structures 22, 23.

Figure 2:
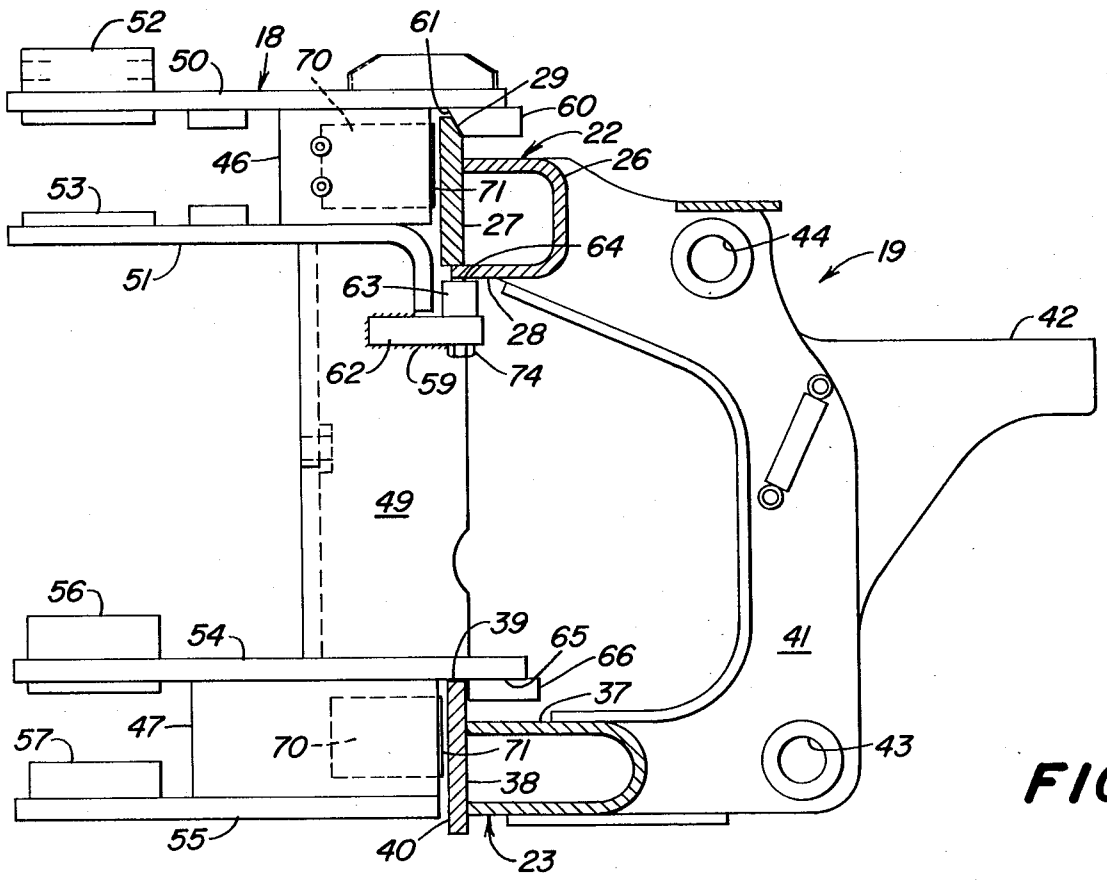
FIG. 2 is a sectional view taken substantially along the line 2—2 of FIG. 1.

Referring now to FIG. 2, the upper track structure 22 is composed of a main transverse U-shaped channel 26 that opens rearwardly. For the purposes of the present disclosure, such terms as "front" or "forward" and "rear" or "rearward" are determined considering the tractor to be "forward" or in "front" of the backhoe and conversely the backhoe being "rearward" or to the "rear" of the tractor. The rear end of the upper leg and the rear end of the lower leg of the U-shaped channel 26 is welded to a vertical track 27. The rear vertical face of the track 27 faces the backhoe. As may be seen, the lower leg of the U-shaped channel 26 provides a flat horizontal surface 28 that extends the full width of the main frame. The upper edge has a chamfered surface 29 which is inclined downwardly and forwardly toward the tractor.

The lower track structure 23 includes a U-shaped channel 37 that extends substantially the full width of the main frame 19. Welded to the rear edges of the legs of the U-shaped channel 37 is a vertical track 38 having an upper horizontal edge surface 39. The track has a vertical surface 40 that faces the backhoe. The transverse track structures 22, 23 and particularly their main transverse beams 26, 37 are joined in a central location by a cast webbing structure 41 having a forwardly extending arm 42, lower pin openings 43, and upper pin openings 44, that are used in mounting the casting 41 and the entire main frame 19 on the tractor. Details of the mounting structure 41 and the manner in which it is mounted on the tractor are not part of the present invention and consequently will not be discussed in detail. There are many well known ways to mount a frame on a tractor and the one used by the present inventor is more or less conventional.

The slide frame 18 is composed of a basic upright and rectangular shaped structure that fits adjacent the vertical facings of the tracks 27, 38. The rectangular shaped structure 45 is composed of horizontal structural members 46, 47 that face respectively and are opposite the faces of the tracks 27, 38, and a pair of vertical post structures 48, 49 that extend and are rigid with opposite ends of the horizontal members 46, 47. Projecting from the upper horizontal structure 46 are rearwardly projecting horizontal arms 50, 51 that have integral therewith a pair of bushing housings 52, 53. Directly below the arms 50, 51 are a second pair of arms 54, 55 that project rearwardly and have bushing housings 56, 57. Carried in the bushing housings 52, 53 are suitable bearings that support a pin, not shown, which extends through a forwardly projecting arm on the subframe 17. Similarly, the lower bushing housings 56, 57 carry suitable bearings that support a pin, not shown, which connects a lower arm of the backhoe subframe 17 to the sliding frame 18. A forward extension of the upper arm 50 extends over the upper end of the track 27 and has welded thereto a wedge bar 60 that fits forwardly of the chamfered surface 29. The wedge bar 60 has an inclined edge surface 61 that is opposite to and engages the chamfered surface 29. Ledges or shelf plates 62 are welded at 59 to the posts 48,49; only one of which is shown with respect to post 49, and projects forwardly in underlying relation to the track 27 and the surface 28 of the U-shaped channel 26. Carried on the forwardmost ends of shelf plates 62 is a lock bar 63 that has an upper horizontal surface 64 that is opposite and underlies the surface 28. For reasons that will become apparent at a later time, the vertical distance between the inclined surface 61 of wedge bar 60 and the surface 64 of the locking bar 63 is slightly greater than the vertical distance between the chamfered surface 29 and the surface 28 of the channel 26.

The arm 54 has a forward extension that projects over the horizontal leg portion 39 of track 38. For purposes as will later become apparent through description of the structures shown in FIGS. 3 and 4, the vertical distance between the surfaces 28 and the upper surface 39 of track 38 is slightly greater than the vertical distance between the surface 64 and the lower horizontal surface 65 of the extension of leg 54. These different vertical distances and these described above with respect to surfaces 61, 64, 28, 29 is designed into this backhoe to give some vertical play to the slide frame 18 and permits it to shift vertically. A bar 66 is welded to and depends from the surface 65 just forwardly of the upper edge portion of track 38 and traps the track 38 between the bar 66 and the forward surface of lower beam 47. It should also be noted that there is permitted a small fore-and-aft play between the frames 19 and 18.

Mounted on the rectangular frame 45 generally at each corner thereof are horizontally extending hydraulic cylinders 70 having forwardly projecting horizontal rams 71 that engage the vertical surfaces of the tracks 27 and 38. Full extension of the upper cylinders 70 causes the inclined surfaces 61 on wedge bar 60 to move up the ramp or chamfered surface 29 to cause a strong wedging action between those surfaces. Such action will also cause the entire slide frame 18 to shift vertically. When this occurs, the lower horizontal surface 65 on the forward extension of arm 54 will separate vertically from the upper surface 39 of track 38. The cylinders 70 on the lower corners, when extended, will prevent sliding action and will serve to lock the lower portion of the slide frame to the track. When all the respective cylinders 70 are retracted and the rams 71 are out of contact with their respective tracks, the sliding frame 18 will then drop as the removal of pressure permits the chamfered surfaces 29, 61 to slide relative to one another. However, as this occurs the forward extension of arm 54 contacts the upper surface 39 of the track 38 and consequently there will be only a very slight wedging action between the surfaces 29, 61. The load created by the weights of the sliding frame and its associated backhoe will be carried almost entirely by the track 38.

Figure 3:
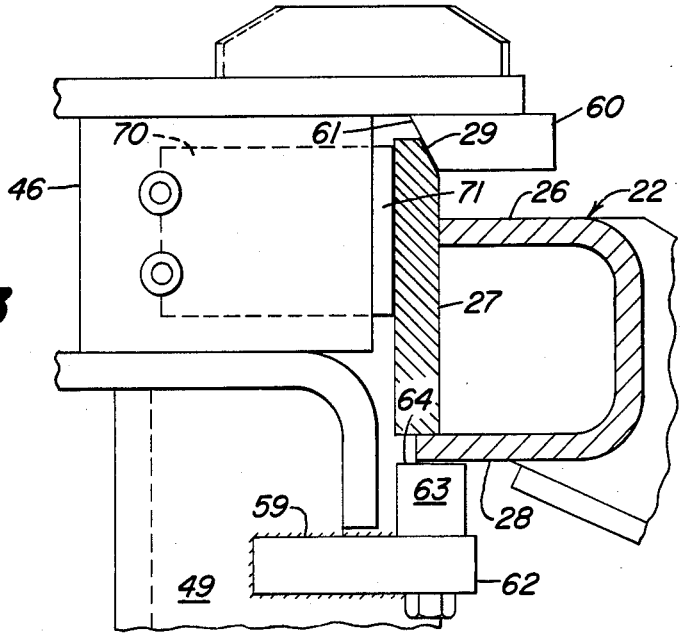
FIG. 3 is an enlarged side view of the upper portion of the slide frame and the upper track and with the locking cylinder extended.
Figure 4:
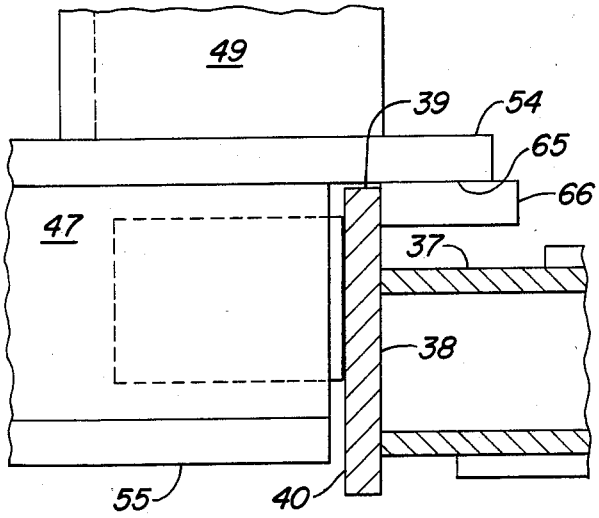
FIG. 4 is a view similar to FIG. 3 but showing the lower portion of the slide frame and lower track and with the locking cylinder extended.

It has been determined that there are certain advantages of having chamfered or inclined wedging surfaces for use in locking a slide frame to the tracks of a backhoe. The one problem with this occurs because it becomes difficult to slide the sliding frame transversely along the tracks due to continued wedging action. In the present structure, the wedging action will occur when the cylinders are extended for locking the slide frame 18 on the track structures 22, 23, as shown in FIGS. 3 and 4. However, when the cylinders are retracted, as shown in FIG. 2, the weight of the backhoe is generally applied by the arm extension of arm 54 to the horizontal surface 39 of track 38. Thus, where the weight of the backhoe is carried there are two horizontal surfaces which provide relative easily slidable action as compared to two matching wedge surfaces. Should any tilting of the slide frame 18 occur in a transverse direction, it will be limited to a point where the upper surface 64 of the locking bar 63 engages the surface 28. Thus, through the present structure there is provided a means for making it relatively easy to slide the frame 18 transversely while also providing a means for strongly locking or latching the slide frame at any desirable position on the main frame.

An additional advantage of the present invention relates to the mounting of the lock bar 63 on the shelves 62. Such is done by cap bolts 74. In mounting the slide frame 18 and its backhoe on the main frame 19, the bar 63 is removed. The frame 18 is then carried by block and tackle until the wedge bar 60 sits on the chamfered surface 29 and the bar 66 sits forward of track 38. The lock bar 63 is then inserted and bolted by bolts 74 to the ledge on shelf 62. By providing the spacing between surface 64 of the lock bar 63 and the surface 28, it makes it very simple to insert and bolt the lock bar 63.

I claim:

1. A supporting structure for a backhoe comprising a main transverse frame adapted to be mounted on a tractor and having upper and lower transverse horizontal tracks extending substantially the full width of the tractor, one of the tracks having a chamfered surface extending downwardly and forwardly from the respective track's upper edge, and the other of said tracks having an upper substantially horizontal surface; a sliding frame adapted for attachment to a backhoe having upper and lower track-engaging portions retained respectfully on the upper and lower tracks, one of said track-engaging portions extending over the upper edge of said one of the tracks and having a downwardly inclined surface opposite to and engageable with said chamfered surface, and the other of the track-engaging portions having a part extending over the aforesaid upper horizontal surface and said part having a horizontal surface facing downwardly and engageable with said upper horizontal surface; and power means extending between the sliding frame and transverse frame and movable in one direction to force separation of said frames and to effect vertical shifting of the sliding frame through sliding of said inclined surface along said chamfered surface to a level in which said horizontal surfaces on said other track and said other track-engaging portion disengage and movable in the reverse direction to permit said horizontal surfaces to engage and cause said track with said upper horizontal surface to substantially support the weight of the backhoe.

2. The invention defined in claim 1 in which the chamfered and inclined surfaces are on the upper track and upper track-engaging portion respectively, and said horizontal surfaces are on the lower track and lower track engaging portion respectively.

3. The invention defined in claim 2 further characterized by said sliding frame having a horizontal ledge extending under the upper track and a lock bar is detachably mounted on the ledge and extends upwardly toward the lower edge of the upper track and said lock bar has an upper surface vertically spaced from adjacent portions of the main frame to permit the sliding frame to shift vertically on the main frame.

4. The invention defined in claim 1 in which the sliding frame includes an upright and rectangular structure and said power means are four hydraulic cylinders positioned at the corners of the rectangular structure and having their respective rams positioned upon extension to engage vertical faces of the upper and lower tracks.

5. A supporting structure for a backhoe comprising a main transversely extending frame detachably mounted on a tractor and having upper and lower transverse tracks with the upper track having a downward chamfered surface facing toward said tractor and the lower track having an upwardly facing horizontal surface, a sliding frame attachable to the backhoe and mounted on the tracks for limited vertical movement between said sliding frame and tracks and limited fore-and-aft movement between said sliding frame and tracks, said sliding frame including an upper portion extending over the upper track and having a matching inclined surface engaging the chamfered surface, and a lower portion having a downwardly facing horizontal surface engageable with the upwardly facing horizontal surface on the lower track; and power means maintained on one and engaging the other of said main and sliding frames and movable in one stroke to cause a wedging and lifting action of the sliding frame on the main frame by a sliding of the inclined surface of the chamfered surface and in a second stroke to remove said wedging action so that the sliding frame drops for support on the horizontal surface of the lower track.

6. The invention defined in claim 5 in which the sliding frame includes an upright rectangular shaped structure and the power means are hydraulic cylinders mounted at the corners of the structure with the two upper cylinders having rams engageable with the upper track and the two lower cylinders having rams engageable with the lower track.

7. A supporting structure for a backhoe comprising a main transverse frame adapted to be mounted on a tractor and having upper and lower transverse horizontal tracks extending substantially the full width of the tractor, each of the tracks having a vertical surface facing away from the tractor, said upper track having a forward downwardly chamfered surface extending from its upper edge toward the tractor, and said lower track having an upper substantially horizontal surface; a sliding frame adapted for attachment to a backhoe having upper and lower track-engaging portions retained respectively on the upper and lower tracks, said upper track-engaging portion extending over the upper edge of said upper track and having a downwardly inclined surface opposite to and engageable with the chamfered surface on said upper track, and said lower track-engaging portion having a horizontal surface facing downwardly and engageable with said upper horizontal surface of said lower track; hydraulic cylinders mounted on the sliding frame opposite the vertical facings on the tracks shiftable in their power strokes to engage the vertical facings to force separation of said frames and to effect vertical shifting of the sliding frame through sliding of said inclined surface along said chamfered surface to a level in which said horizontal surfaces on said lower track and said lower track-engaging portion disengage, said rams being shiftable in the reverse direction to permit the latter horizontal surfaces to engage and for said lower track to substantially carry the weight of the backhoe.

8. A supporting structure for a backhoe comprising a main transverse frame adapted to be mounted on a tractor and having upper and lower transverse horizontal track structures extending substantially the full width of the tractor, said track structures having vertical surfaces facing away from the tractor and upper and lower surfaces extending from the vertical surfaces toward the tractor, said upper surface of said upper track structure being chamfered downwardly toward the tractor and said lower surface being substantially horizontal, and said upper surface of said lower track structure being substantially horizontal and spaced from the aforesaid lower surface of said upper track structure a vertical distance; a sliding frame adapted for attachment to the backhoe having upper and lower track-engaging portions retained respectively on the upper and lower track structures, the upper of said engaging portions having an upper part thereof extending over the upper edge of said upper track and having a downwardly inclined surface opposite to and engageable with the upper chamfered surface on said upper track structure, said upper portion further having a horizontal surface beneath and opposite to said lower surface of said upper track structure, said lower track-engaging portion having a part thereof with a horizontal surface facing downwardly and engageable with said upper horizontal surface of said lower track structure, the vertical distance between the aforesaid horizontal surfaces on the said upper and lower portions being less then the vertical distance between the aforesaid horizontal surfaces on the upper and lower track structures; and power means extending between the sliding frame and transverse frame effecting separation of said frames and shifting of the sliding frame vertically through sliding of said inclined surface along said chamfered surface so that the horizontal surfaces between the lower track structure and lower track-engaging portion move vertically to and from engagement.

9. The invention defined in claim 8 in which the power means are fore-and-aft extending hydraulic cylinders mounted on the sliding frame in horizontal alignment with said vertical facings on said upper and lower track structures, each cylinder having a ram directed toward and engageable upon the power stroke of the respective cylinder with the respective vertical facing on the respective track structure.

* * * * *